United States Patent [19]

Dreml

[11] 4,280,405

[45] Jul. 28, 1981

[54] ASSEMBLY FOR SUPPORTING PRINTING SCREEN

[75] Inventor: Johann Dreml, Franklin, N.C.

[73] Assignee: Peterzimmer America, Inc., Spartanburg, S.C.

[21] Appl. No.: 79,594

[22] Filed: Sep. 27, 1979

[51] Int. Cl.[3] ..... B41F 15/38

[52] U.S. Cl. ..... 101/127.1; 101/116

[58] Field of Search ..... 101/116, 117, 118, 119, 101/120, 127.1; 308/235 US, 174 US

[56] References Cited

U.S. PATENT DOCUMENTS

| | | | |
|---|---|---|---|
| 2,071,824 | 2/1937 | Engert | 101/116 |
| 2,615,389 | 10/1952 | Huebner | 101/119 |
| 2,917,351 | 12/1959 | Franke et al. | 308/174 |
| 3,556,004 | 1/1971 | Mitter et al. | 101/116 |
| 3,565,001 | 2/1971 | Zimmer | 101/116 |
| 3,892,176 | 7/1975 | Van der Winden | 101/116 |
| 3,985,432 | 10/1976 | Hou et al. | 101/116 X |
| 4,026,208 | 5/1977 | Horne, Jr. et al. | 101/116 |

FOREIGN PATENT DOCUMENTS

| | | | |
|---|---|---|---|
| 836793 | 4/1952 | Fed. Rep. of Germany | 101/120 |
| 850677 | 12/1939 | France | 101/120 |

*Primary Examiner*—Edgar S. Burr
*Assistant Examiner*—C. A. Pearson
*Attorney, Agent, or Firm*—Bailey, Dority & Flint

[57] ABSTRACT

An assembly for supporting a cylindrical screen used for printing fabrics and the like. The assembly includes a screen supporting ring which may or may not have teeth on the perimeter thereof. A tensioning ring is nested in the screen supporting ring and is in axial alignment therewith. A bearing is carried between the tensioning ring and the screen supporting ring. Circular seals are carried on opposite sides of the bearing for protecting the bearing from contaminants and the like. Tension is imparted on the screen by pressing against the tensioning ring which forces the screen supporting ring outwardly.

3 Claims, 3 Drawing Figures

ASSEMBLY FOR SUPPORTING PRINTING SCREEN

BACKGROUND OF THE INVENTION

Heretofore gear assemblies for supporting and imparting tension to screens used in printing fabrics and the like included a gear plate or screen supporting ring having a tensioning ring nested therein. Bearings were carried between the tensioning plate and the gear plate for permitting the gear plate to rotate relative to the tensioning ring. The printing screen was in turn connected to the gear plate by means of a coupling which directly connected the screen to the gear plate so that the screen rotated with the gear plate.

During the printing operation it is essential that proper tension be imparted to the screen. This tension is applied by means of an adjustable screw which engages the side wall of the tensioning ring forcing the tensioning ring outward.

One problem with tensioning rings utilized heretofore is that printing dyes and inks utilized are highly corrosive and they contaminated the bearings between the tension ring and the gear plate. Once the bearing became contaminated it would begin to deteriorate affecting the movement of the screen and gear plate relative to the tensioning ring. This in turn of course affected the quality of printing. Normally, heretofore, the seals utilized were rubber seals which would be adversly affected by the corrosive inks and dyes. Once the seal became affected it required a substantial amount of time to disassemble the gear assembly for replacing of the bearings.

SUMMARY OF THE INVENTION

This invention relates to an assembly for supporting cylindrical screens and more particularly to a sealed bearing assembly utilized with a tension ring and gear plate provided for supporting and rotating a screen used in printing fabrics.

Since screens used for printing fabrics and the like are very flimsy resulting from the porosity of the thin metallic sheet used in constructing the screen, it is essential that proper tension be imparted to the screen during the printing operation. The assembly constructed in accordance with the present invention for supporting the screen is provided for connecting to conventional cylindrical plastic couplings that are fitted within the ends of the screen.

The assembly includes a cylindrical screen supporting ring which may be a gear plate for use on one end of the screen or may be an identical plate without the gear teeth thereon. It is only necessary to drive the screen from one end. A cylindrical tensioning ring is in axial alignment with the cylindrical supporting ring or gear plate with the tensioning ring being nested within the gear plate with the inner walls being positioned adjacent to each other with a gap provided therebetween. A cylindrically extending cavity is provided in the inner walls of the tensioning ring and the supporting ring for receiving a bearing means. In one particular embodiment the bearing means is a conventional wire bearing while in the other embodiment the bearing means is a four point contact bearing.

A first concentric groove is provided in the inner walls of the supporting ring and tensioning ring on one side of the bearing means and a second concentric groove is provided in opposed surfaces of the inner walls of the supporting ring and tensioning ring on the other side of the bearing means. Flat circular seals constructed of non-corrosive plastic material such as teflon or nylon are carried in the first and second grooves spanning the separation between the supporting ring and the tensioning ring providing a seal for the bearing means.

In order to prevent grease and dye from flowing along the surface of the tensioning ring into the gap between the gear plate and tensioning ring, a raised abutment is carried on the outer periphery of the tensioning ring and overlaps the gap. The raised abutment has arcuate surface in a wall opposite from the gap so as to direct any grease and dye away from the gap.

Accordingly, it is an important object of the present invention to provide an assembly for supporting rotating screens utilized in printing of fabrics and the like which is very durable and easy to maintain.

Another important object of the present invention is to provide a sealed bearing in an assembly for supporting screens used in printing fabrics and the like.

Another important object of the present invention is to provide an assembly for supporting cylindrical screens used in printing fabrics and the like which can be readily repaired.

These and other objects and advantages of the invention will become apparent upon reference to the following specifications, attendant claims, and drawings.

DESCRIPTION OF A PREFERRED EMBODIMENT

Figure 1:
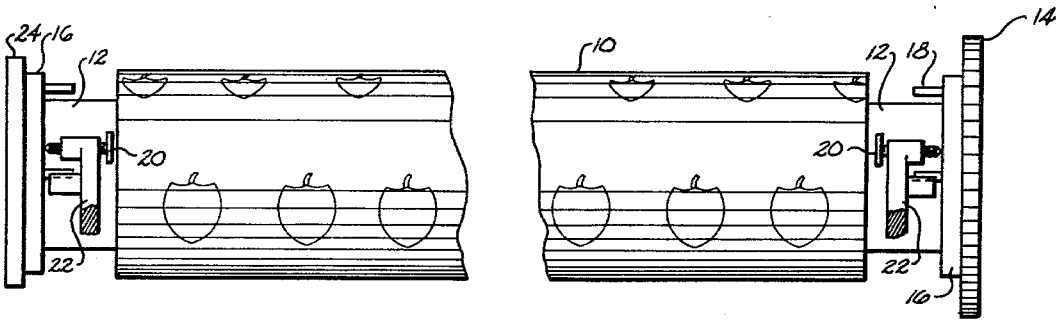
FIG. 1 is an elevational view illustrating an assembly constructed in accordance with the present invention for supporting a screen used in printing fabrics.

As can be seen in FIG. 1 there is illustrated a conventional assembly for supporting cylindrical screen 10 used for printing fabrics and the like. The screen is constructed of a relatively thin porous metallic material so as to permit ink to pass there through in accordance with the pattern carried thereon. It is essential during the printing operation that tension be imparted to the screen during the printing operation. Conventional cylindrical couplings 12 such as plastic cylinders are inserted in the ends of the screen and secured thereto by any suitable means with the outer ends thereof provided for being inserted into and connected to a cylindrical screen supporting ring 14. Nested within the screen supporting ring 14 is a cylindrical tensioning ring 16. The tensioning ring 16 normally has three positioning pins 18 extending axially therefrom upon which the tensioning ring is supported and as a result the entire screen. An adjustable threaded screw 20 is carried within an arm 22 positioned adjacent the tensioning ring 16 for imparting axial pressure to the tension ring and in turn to the screen. A similar tensioning screw 20 is carried on the other end of the screen. It is noted that the gear 14 has teeth therein which mesh with gears carried on the printing machine for rotating the screen 10. The screen supporting ring 24 provided on the other end of the screen is identical to the gear 14 with the exception that it does not have teeth on the peripheral surface thereof since driving takes place through the gear 14.

Figure 2:
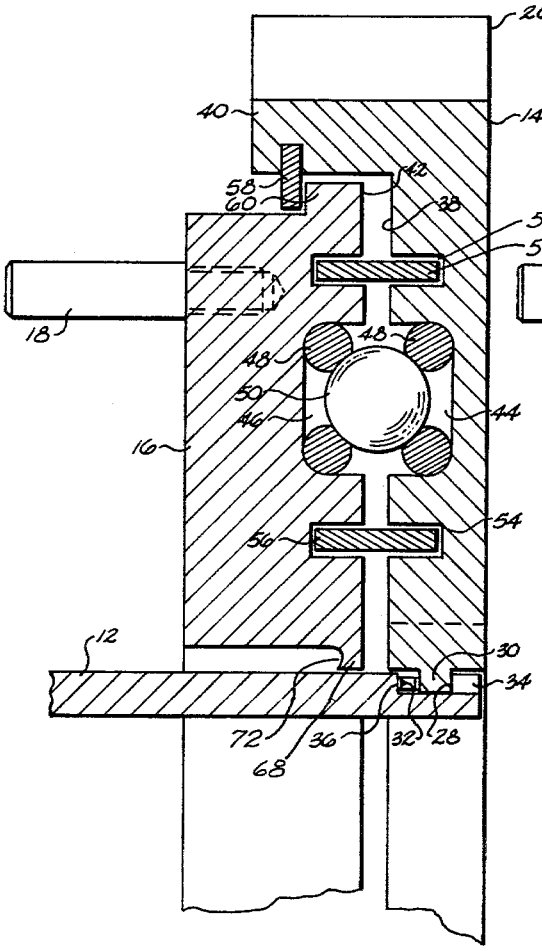
FIG. 2 is a longitudinal sectional view of a screen supporting ring of FIG. 1.
Figure 3:
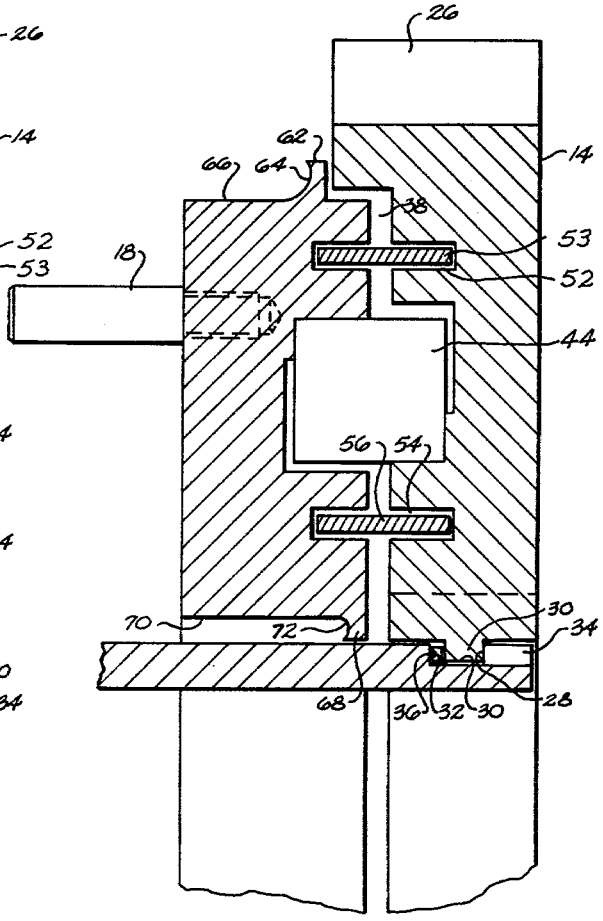
FIG. 3 is a sectional view illustrating a modified form of the invention.

In FIGS. 2 and 3 there is illustrated an assembly constructed in accordance with the present invention and it is understood both of the devices shown in 2 and 3 have teeth 26 provided thereon; however, the left hand ring 24 as shown in FIG. 1 would be identical to that shown in FIGS. 2 and 3 with the teeth removed therefrom.

The screen supporting ring or gear plate 14 has a circular axial opening provided therein through which the coupling 12 extends for connecting the screen to the gear plate by means of any suitable conventional connection. Normally extending around the cylindrical opening provided in the gear plate 14 are a plurality of circumferentially spaced slots. Interposed between the slots are recesses 28 provided in the outer surface of the gear plate 14. The recesses 28 terminate in the flanges 30 which have leaf springs 32 carried on the opposite wall.

The coupling member 12 has at least one radially extending flange 34 provided adjacent the end thereof which is permitted to fit through the slots provided in the gear plate and rotated over the recess 28. The leaf spring 32 bears against a flange 36 carried on the coupling 12 forcing the flange 34 into the recess 28. As previously mentioned this is a conventional method of attaching the screen to the gear plate and other suitable means could be utilized.

The gear plate 14 has a recessed inner wall 38 with a circumferentially extending flange 40 upon which the teeth 26 are carried. Nested within the gear plate 14 is the tension ring 16 which has an axial bore extending therethrough which the coupling member 12 passes for being secured to the gear plate. There is no connection between the tension ring 16 and the coupling 12. An inner wall 42 of the tension ring 16 is spaced from the inner wall 38 of the gear plate by means of a bearing generally designated by the reference character 44 so as to permit the gear plate to rotate freely relative to the tensioning ring 16. A cylindrically extending cavity 46 is provided in the inner walls of the tension ring and gear plate for receiving a wire bearing 44. The wire bearing includes four space wires 48 and a plurality of balls 50 that are carried therebetween.

In order to seal the bearing from the corrosive dyes and inks used during the printing operation, an outer cylindrical groove 52 is provided in the inner walls of the gear plate and the tension ring for receiving a substantially flat plastic cylindrical seal 53. A similar circular groove 54 is provided on the other side of the bearing for receiving inner circular flat plastic ring 56. The plastic rings may be constructed of any suitable material, such as teflon or nylon, that is not adversely affected by the grease and dyes. A locking ring 58 is carried in the flange 40 of the gear plate and pressed against a flange 60 provided on the tension ring for securing the tension ring within the gear plate.

In order to prevent grease and dyes from entering the gap provided between the tension ring and gear plate and contaminating the bearing, an outwardly projecting flange 62 is provided on the peripheral edge of the tension ring 16 shown in FIG. 3. An arcuate surface 64 is provided on the side of the flange opposite the gap so as to direct any dye or grease flowing along the outer surface 66 of the tension ring away from the gap.

Another inwardly projecting flange 68 is provided on the inner wall of the tension ring for preventing grease and the like from flowing along the inner surface 70 of the tension ring. An arcuate surface 72 is provided on this flange 68 for directing the grease away from the gap.

It is noted that both of the flanges 62 and 68 extend entirely around the tension ring.

While a preferred embodiment of the invention has been described using specific terms, such description is for illustrative purposes only, and it is understood that changes and variations may be made without departing from the spirit or scope of the following claims.

What is claimed is:

1. An assembly for supporting cylindrical screens used in printing fabrics and the like, cylindrical couplings extending out opposed ends of said screens, said assembly comprising:

a cylindrical screen supporting ring;

means for connecting said cylindrical coupling carried on an end of said screen to said cylindrical screen supporting ring;

a cylindrical tension ring carried in axial alignment with said cylindrical supporting ring with said tension ring and said supporting ring having inner walls nesting together;

a cylindrically extending cavity provided in said inner walls of said tension ring and said supporting ring;

bearing means carried in said cavity for permitting said screen supporting ring to rotate relative to said tension ring and forming a separation between said supporting ring and said tension ring;

seal means carried on opposite sides of said bearing means, an outwardly projecting flange carried on a peripherial edge of said tension ring adjacent said separation, and an arcuate surface provided on an opposite side of said flange from said gap for directing contaminants away from said separation.

2. An assembly for supporting cylindrical screens used in printing fabrics and the like, cylindrical couplings extending out opposed ends of said screens, said assembly comprising:

a cylindrical screen supporting ring;

means for connecting said cylindrical coupling carried on an end of said screen to said cylindrical screen supporting ring;

a cylindrical tension ring carried in axial alignment with said screen supporting ring with said tension ring and said screen supporting ring having inner walls nesting together;

a cylindrically extending cavity provided in said inner walls of said tension ring and said supporting ring;

bearing means carried in said cavity for permitting said screen supporting ring to rotate relative to said tension ring and forming a separation between said supporting ring and said tension ring;

a first concentric groove provided in opposed surfaces of said inner walls of said supporting ring and tension ring on one side of said bearing means;

a second concentric groove provided in opposed surfaces of said inner walls of said supporting ring and tension ring on the other side of said bearing means, flat circular seals carried in said first and second grooves spanning said separation between said supporting ring and said tension ring for sealing said bearing from contaminants a recess provided in said inner wall of said screen supporting ring;

said tension ring extending in said recess with said separation between said supporting ring and said tension ring extending above a peripheral edge of said tension ring;

an outwardly projecting flange carried on said peripheral edge of said tension ring adjacent said separation; and an arcuate surface provided on an opposite side of said flange from said gap for directing contaminates away from said separation.

3. The assembly as set forth in claim 1 further comprising:

said bearing means being a wire bearing.

* * * * *